US005216869A

United States Patent [19]

Boldrini et al.

[11] Patent Number: 5,216,869

[45] Date of Patent: Jun. 8, 1993

[54] FLIP TOP CIGARETTE PACKING MACHINE

[75] Inventors: Fulvio Boldrini, Ferrara; Antonio Gamberini, Bologna, both of Italy

[73] Assignee: G. D. Societa' per Azioni, Italy

[21] Appl. No.: 821,357

[22] Filed: Jan. 15, 1992

[30] Foreign Application Priority Data

Jan. 25, 1991 [IT] Italy ..... B091A000019

[51] Int. Cl.[5] ..... B65B 51/20

[52] U.S. Cl. ..... 53/387.3; 53/234; 53/387.4

[58] Field of Search ..... 53/234, 387.2, 387.3, 53/387.4; 198/408, 462

[56] References Cited

U.S. PATENT DOCUMENTS

| | | | |
|---|---|---|---|
| 2,254,291 | 9/1941 | Joa | 198/462 X |
| 3,105,334 | 10/1963 | Marshall | 53/387.2 X |
| 4,223,779 | 9/1980 | Hopkins | 198/408 X |
| 4,484,432 | 11/1984 | Oberdorf | 53/234 X |
| 4,999,970 | 3/1991 | Bamrungbhuet | 53/239 X |

FOREIGN PATENT DOCUMENTS

| | | |
|---|---|---|
| 2134870A | 8/1984 | United Kingdom . |
| 2220911A | 1/1990 | United Kingdom . |

*Primary Examiner*—John Sipos

*Attorney, Agent, or Firm*—Marshall, O'Toole, Gerstein, Murray & Borun

[57] ABSTRACT

A machine for packing cigarettes in rigid flip-top packs, wherein flat blanks are fed on to a wrapping wheel and each folded about a respective preformed group of cigarettes for forming a pack having gummed mating portions; and wherein the formed packs are transferred from the wrapping wheel to the bottom end of a first substantially vertical branch of a loop conveyor, and fed upwards to an unloading station at the top end of the first branch of the conveyor, where they are fed into a stabilizing and drying conduit extending over the packing machine and about a heating device consisting of at least one lubricating oil tank on the machine.

9 Claims, 1 Drawing Sheet

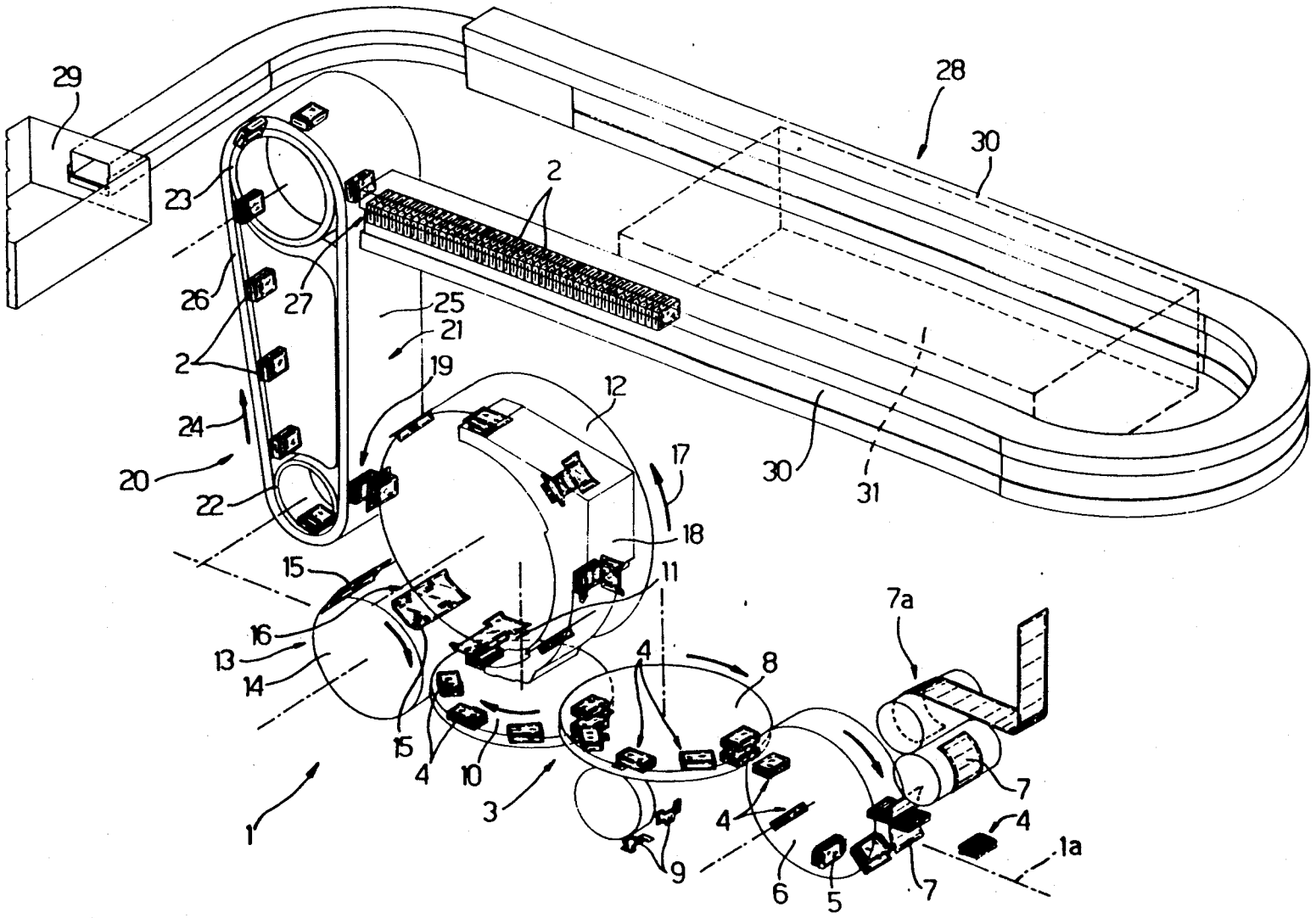
28
30
29
2
25
21
27
23
26
2
24
20
22
19
12
17
18
11
31
30
7a
7
4
1a
7
5
6
8
4
9
4
3
10
4
15
15
16
13
14
1

FLIP TOP CIGARETTE PACKING MACHINE

BACKGROUND OF THE INVENTION

The present invention relates to a flip-top cigarette packing machine.

Flip-top packs of cigarettes are generally formed on machines comprising a wrapping wheel designed to receive a first series of preformed groups of cigarettes, and a second series of flat planks, each of which is folded, on the wheel, about a respective group of cigarettes to produce a rigid pack with gummed mating portions, which is usually transferred from the wrapping wheel on to a drying conveyor. As the packs travel along the drying conveyor, the gum used to join the folded mating portions of the blanks dries to ensure firm shaping of the newly formed packs.

The wrapping wheel and drying conveyor are known to consist of a first and second substantially vertical conveyor wheel arranged perpendicularly tangent to each other. The first wheel, used for wrapping, is usually arranged substantially parallel to the longer longitudinal horizontal axis of the packing machine, while the second, used as a drying conveyor, is arranged crosswise in relation to said axis, and normally presents a stabilizing end conduit substantially parallel to said axis and extending outwards of the packing machine.

Despite providing for an extremely compact packing machine enabling full access to the component parts by the operator, the above configuration presents a number of drawbacks.

Firstly, being arranged substantially vertically, and perpendicularly tangent to each other, the two wheels must be mounted with their rotation axes substantially horizontal and coplanar to each other. Also, being mounted at operator level over the same base, both wheels must present substantially the same diameters.

Consequently, the stabilizing conduit, though arranged facing the upper peripheral portion of the second wheel, extends outwards of the packing machine at such a low level that expensive, cumbersome lifting devices are required for connecting it to the overhead pack conveyors normally featured in the system.

Secondly, the height of the stabilizing conduit is usually such as to prevent operators and trucks from circulating freely between the packing and processing lines at the plant.

SUMMARY OF THE INVENTION

It is an object of the present invention to provide a cigarette packing machine designed to overcome the aforementioned drawbacks.

According to the present invention, there is provided a machine for packing cigarettes in rigid flip-top packs, said machine comprising a substantially vertical wrapping wheel rotating about a substantially horizontal axis; first means for supplying said wrapping wheel with a first series of preformed groups of cigarettes; second means for supplying said wrapping wheel with a second series of flat blanks, each folded, on said wrapping wheel, about a respective preformed group of cigarettes, to produce a rigid pack with gummed mating portions; a loading station along said wrapping wheel; and drying conveyor means cooperating with said wrapping wheel, for receiving said packs at said loading station; characterised by the fact that said conveyor means comprise a loop conveyor, in turn comprising a first and second substantially vertical branch; said first branch being substantially tangent to the outer periphery of said wrapping wheel, and extending upwards from said loading station and through a top unloading station.

On the machine described above, therefore, the drying conveyor is obviously vertical, the length of which may be so selected as to locate the unloading station at a height enabling the cumbersome lifting devices mentioned above to be dispensed with.

Also, the distance traveled by the packs on the conveyor may preferably be made as long as possible, for better drying the gum, by operating the conveyor so that the packs are fed between the loading and unloading stations along the second branch.

On the above machine, therefore, being located on the same branch of the drying conveyor, both the loading and unloading station are arranged facing the wrapping wheel.

According to a preferred embodiment of the above machine, the stabilizing conduit cooperating with the drying conveyor may therefore be located at the unloading station, and extend over the machine, to prevent cluttering the surrounding area.

For fully drying the gum and stabilizing the packs, the stabilizing conduit may preferably present heating means comprising, according to a preferred embodiment of the above machine, passive dissipators preferably consisting of the machine lubricating oil tanks about which the stabilizing conduit is at least partially wound.

BRIEF DESCRIPTION OF THE DRAWING

The present invention will be described with reference to the accompanying drawing, which shows a schematic view in perspective of a preferred non-limiting embodiment, with parts removed for simplicity.

DETAILED DESCRIPTION OF THE INVENTION

Number 1 in the accompanying drawing indicates a machine for packing cigarettes in rigid flip-top packs 2.

Machine 1 comprises a known line 3 for supplying reformed groups 4 of a given number of cigarettes, usually twenty, arranged in a number of layers, usually three, prewrapped in a wrapping 5, usually consisting of oil paper, on a known horizontal-axis prewrapping wheel 6, which successively receives sheets of foil 7 from a known supply line 7*a*, on one side, and groups 4, on the other.

Line 3 also comprises a vertical-axis wheel 8 aligned with wheel 6 along longitudinal axis 1*a* of machine 1, and rotating about its axis for receiving groups 4 in known manner rom wheel 6, and feeding them through a loading station where each group 4 is fitted in known manner (not shown) with an inner strengthening element or collar 9.

Line 3 also comprises a known conveyor wheel 10 rotating about a vertical axis for receiving groups 4 from wheel 8 and feeding them to a first loading station 11 on the periphery of a wrapping wheel 12 rotating about a horizontal axis and substantially aligned with wheels 8 and 10 along axis 1*a*. In particular, wheel 12 is arranged substantially vertically and parallel to axis 1*a*, and wheel 10 presents a peripheral portion located beneath the periphery of wheel 12 at loading station 11, to enable a vertical pusher (no shown). to expel groups 4, in known manner, axially upwards in relation to wheel 10, and feed them radially on to wheel 12.

Machine 1 also comprises a line 13 (of which only end wheel 14 is shown) for feeding blanks 15 on to wrapping wheel 12 at a second loading station 16 located upstream from loading station 11 in relation to the rotation direction of wheel 12 shown by arrow 17.

As it is fed about wheel 12, each blank 15 cooperates in known manner with a known folding and gumming device 18 on wheel 12, and is folded about a respective group 4 to produce a substantially finished pack 2 comprising a number of gummed mating portions (not shown).

Each pack 2 is completed in known manner at a loading station 19, where it is transferred, by known means not shown, on to a conveyor indicated as a whole by 20 and arranged tangent to the periphery of wheel 12 at loading station 19.

Conveyor 20 comprises a conveyor belt 21 looped about two superimposed pulleys 22, 23 parallel to the axis of wheel 12, and one of which is powered for moving belt 21 in the direction of arrow 24 opposite that of arrow 17. Pulleys 22 and 23 define, along belt 21, a first and second substantially vertical branch 25 and 26, branch 25 extending upwards from loading station 19 to an unloading station 27 over and on the same side as wheel 12 in relation to conveyor 20. Directions 17 and 24 are so oriented that packs 2 are fed about both pulleys 22 and 23 and along second branch 26 between loading station 19 and unloading station 27.

At unloading station 27, packs 2 are fed successively, by known transfer means not shown, into a substantially horizontal stabilizing and drying conduit 28 extending substantially in a U over machine 1 and connected directly to an overhead pack conveyor 29.

Conduit 28 comprises two substantially straight arms 30 parallel to axis 1*a* and on either side of at least one lubricating and cooling oil tank 31 on machine 1, which acts as a passive dissipator for heating conduit 28 to a substantially constant temperature.

The present invention therefore provides, in an extremely straightforward and low-cost manner, for fully drying the gum and so stabilizing packs 2 as these travel along conduit 28.

We claim:

1. A machine (1) for packing cigarettes in rigid flip-top packs (2), said machine (1) comprising a, substantially vertical wrapping wheel (12) rotating about a substantially horizontal axis; first means (3) for supplying said wrapping wheel (12) with a first series of preformed groups (4) of cigarettes; second means (13) for supplying said wrapping wheel (12) with a second series of flat blanks (15), each folded, on said wrapping wheel (12), about a respective preformed group (4) of cigarettes, to produce a rigid pack (2) with gummed mating portions; a loading station (19) along said wrapping wheel (12); and drying conveyor means cooperating with said wrapping wheel (12), for receiving said packs (2) at said loading station (19); characterised by the fact that said conveyor means comprise a loop conveyor (20), in turn comprising a first and second substantially vertical branch (25, 26); said first branch (25) being substantially tangent to the outer periphery of said wrapping wheel (12), and extending upwards from said loading station (19) and through a top unloading station (27).

2. A machine as claimed in claim 1, characterised by the fact that said loop conveyor (20) comprises drive means (22, 23) by which it is operated in such a manner that said packs (2) are fed from said loading station (19) to said unloading station (27) along said second branch (26).

3. A machine as claimed in claim 1, characterised by the fact that it also comprises a stabilizing and drying conduit (28) connected to said loop conveyor (20) at said unloading station (27) and extending over said machine (1).

4. A machine as claimed in claim 3, characterised by the fact that said stabilizing and drying conduit (28) presents heating means (31).

5. A machine as claimed in claim 4, characterised by the fact that said heating means 31 comprise passive heat dissipators.

6. A machine as claimed in claim 4, characterised by the fact that said heating means (31) comprise at least one lubricating oil tank on said machine (1), about which said stabilizing and drying conduit (28) is at least partially wound.

7. A machine (1) for packing cigarettes in rigid flip-top packs (2), said machine (1) comprising a substantially vertical wrapping wheel (12) rotating about a substantially horizontal axis; first means (3) for supplying said wrapping wheel (12) with a first series of preformed groups (4) of cigarettes; second means (13) for supplying said wrapping wheel (12) with a second series of flat blanks (15), each folded, on said wrapping wheel (12), about a respective preformed group (4) of cigarettes, to produce a rigid pack (2) with gummed mating portions; a loading station (19) alongside the wrapping wheel (12); and drying conveyor means cooperating with the wrapping wheel (12), for receiving the packs (2) at the loading station (19); the drying conveyor means comprises a loop conveyor (20) supported by an upper pulley (23) and a lower pulley (22), the loop conveyor (20) having a downwardly movable first substantially vertical branch (25) and an upwardly movable second substantially vertical branch (26); the first branch (25) being substantially tangent to the outer periphery of the wrapping wheel (12), and extending upwards from the loading station (19) and into communication with a top unloading station (27).

8. A machine as claimed in claim 7 in which the loop conveyor (20) has drive means (22, 23) to drive the loop conveyor (20) so that the packs (2) are fed from said loading station (19) to the unloading station (27) by means of the second branch (26).

9. A machine (1) for packing cigarettes in rigid flip-top packs (2), said machine (1) comprising a substantially vertical wrapping wheel (12) rotating about a substantially horizontal axis; first means (3) for supplying said wrapping wheel (12) with a first series of preformed groups (4) of cigarettes; second means (13) for supplying said wrapping wheel (12) with a second series of flat blanks (15), each folded, on said wrapping wheel (12), about a respective preformed group (4) of cigarettes, to produce a rigid pack (2) with gummed mating portions; a loading station (19) alongside the wrapping wheel (12); and drying conveyor means cooperating with the wrapping wheel (12), for receiving the packs (2) at the loading station (19); the drying conveyor means comprises a loop conveyor (20), the loop conveyor (20) having a downwardly movable first substantially vertical branch (25) and an upwardly movable second substantially vertical branch (26); the first branch (25) being substantially tangent to the outer periphery of the wrapping wheel (12), and extending upwards from said loading station (19) and through a top unloading station (27);

the first branch (25) communicating with a lower portion of the second branch whereby packs are fed from the loading station (19) to the second branch (26); and the second branch (26) having an upper portion communicating with the first branch (25) above the unloading station.

* * * * *